US006848996B2

(12) United States Patent
Hecht et al.

(10) Patent No.: US 6,848,996 B2
(45) Date of Patent: Feb. 1, 2005

(54) GAMING DEVICE WITH SOUND RECORDING CHANGES ASSOCIATED WITH PLAYER INPUTS

(75) Inventors: William L. Hecht, Reno, NV (US); Kristopher E. Landrum, South Lake Tha e, CA (US)

(73) Assignee: IGT, Reno, NV (US)

( * ) Notice: Subject to any disclaimer, the term of this patent is extended or adjusted under 35 U.S.C. 154(b) by 207 days.

(21) Appl. No.: 09/978,607

(22) Filed: Oct. 15, 2001

(65) Prior Publication Data

US 2003/0073489 A1 Apr. 17, 2003

(51) Int. Cl.[7] ..... A63F 9/00

(52) U.S. Cl. ..... 463/35; 463/16; 463/30; 463/43

(58) Field of Search ..... 463/16–22, 30–35, 463/43, 12, 13; 273/459, 460, 121 B, 138.1, 139; 84/669, 645, 609, 651, 610, 652, 634, 650; 381/123, 61; 345/716

(56) References Cited

U.S. PATENT DOCUMENTS

| | | | |
|---|---|---|---|
| 3,831,172 | A | 8/1974 | Olliges et al. |
| 4,300,225 | A | 11/1981 | Lambl |
| 4,314,236 | A | 2/1982 | Mayer et al. |
| 4,339,798 | A | 7/1982 | Hedges et al. |
| 4,344,345 | A | 8/1982 | Sano |
| 4,363,482 | A | 12/1982 | Goldfarb |
| RE31,441 | E | 11/1983 | Nutting et al. |
| 4,582,324 | A | 4/1986 | Koza et al. |
| 4,618,150 | A | 10/1986 | Kimura |
| 4,624,459 | A | 11/1986 | Kaufman |
| 4,660,107 | A | 4/1987 | Chippendale, Jr. |
| 4,695,053 | A | 9/1987 | Vazquez, Jr. et al. |
| 4,712,189 | A | 12/1987 | Mohri |
| 4,732,386 | A | 3/1988 | Rayfiel |
| 4,733,593 | A | 3/1988 | Rothbart |
| 4,791,558 | A | 12/1988 | Chaitin et al. |
| 4,876,937 | A | 10/1989 | Suzuki |
| 4,974,483 | A | 12/1990 | Luzzatto |
| 5,096,195 | A | 3/1992 | Gimmon |

(List continued on next page.)

FOREIGN PATENT DOCUMENTS

| | | | |
|---|---|---|---|
| EP | 0 978 809 | A2 | 2/2000 |
| EP | 0 997 856 | A2 | 5/2000 |
| EP | 0 997 857 | A2 | 5/2000 |
| EP | 1 079 345 | A1 | 2/2001 |
| EP | 1 225 565 | A2 | 7/2002 |
| GB | 2201279 | A | 8/1988 |
| JP | 1197292 | A | 12/1997 |
| JP | 411216221 | A | 8/1999 |
| JP | 02000296209 | A | 10/2000 |

OTHER PUBLICATIONS

Article, "A Salute to Game Shows–The Price Is Right–Pricing Games–Three Strikes," p. 8 of 9, online, retrieved on Aug. 16, 2000. Retrieved from the Internet: <http://ben–s–chumin.simplenet.com/game–shows/shows/price–is–right/pricing–games–4.htm>.

(List continued on next page.)

*Primary Examiner*—Xuan M. Thai
*Assistant Examiner*—Yveste Cherubin
(74) *Attorney, Agent, or Firm*—Bell, Boyd & Lloyd LLC

(57) ABSTRACT

The present invention involves a gaming device which includes in data storage at least one primary sound file, at least one variant sound file which is a variation of the primary sound file and at least one player input event associated with the variant sound file. When a predetermined event occurs, the gaming device plays the primary sound file, and when the player makes a predetermined input, the gaming device plays the variant sound file and stops playing the primary sound file. The present invention provides gaming devices with enhanced sound and music capabilities, adding to a gaming device player's enjoyment and entertainment.

25 Claims, 6 Drawing Sheets

U.S. PATENT DOCUMENTS 5,119,465 A 6/1992 Jack
5,179,517 A 1/1993 Sarbin et al.
5,221,801 A 6/1993 Bruti et al.
5,242,163 A 9/1993 Fulton
5,258,574 A 11/1993 Kawano
5,266,736 A 11/1993 Saito
5,275,400 A 1/1994 Weingardt et al.
5,331,112 A * 7/1994 Sato et al. ..... 84/609
5,342,047 A 8/1994 Heidel et al.
5,371,345 A 12/1994 LeStrange et al.
5,390,938 A 2/1995 Takeya
5,393,061 A 2/1995 Manship et al.
5,393,070 A 2/1995 Best
5,430,835 A 7/1995 Williams et al.
5,446,902 A 8/1995 Islam
5,449,173 A 9/1995 Thomas et al.
5,472,197 A 12/1995 Gwiasda et al.
5,515,764 A 5/1996 Rosen
5,577,253 A 11/1996 Blickstein
5,606,144 A * 2/1997 Dabby ..... 84/649
5,625,845 A 4/1997 Allran
5,668,996 A 9/1997 Radinsky
5,695,188 A 12/1997 Ishibashi
5,697,843 A 12/1997 Manship et al.
5,703,310 A 12/1997 Kurakake et al.
5,707,286 A 1/1998 Carlson
5,715,459 A 2/1998 Celi
5,745,761 A 4/1998 Celi
5,745,762 A 4/1998 Celi
5,758,875 A 6/1998 Giacalone, Jr.
5,762,552 A 6/1998 Vuong et al.
5,766,074 A 6/1998 Cannon et al.
5,772,509 A 6/1998 Weiss
5,778,231 A 7/1998 Van Hoff
5,792,972 A 8/1998 Houston
5,802,364 A 9/1998 Senator
5,807,172 A 9/1998 Piechowiak
5,809,303 A 9/1998 Senator
5,833,538 A 11/1998 Weiss
5,839,958 A 11/1998 Ozarow
5,848,932 A 12/1998 Adams
5,854,927 A 12/1998 Gelissen
5,880,386 A 3/1999 Wachi et al.
5,889,990 A 3/1999 Coleman
5,892,171 A 4/1999 Ide
5,902,184 A 5/1999 Bennett et al.
5,908,354 A 6/1999 Okuniewicz
5,910,048 A 6/1999 Feinberg
5,911,071 A 6/1999 Jordan
5,920,720 A 7/1999 Toutonghi
5,923,878 A 7/1999 Marsland
5,923,880 A 7/1999 Rose
5,930,509 A 7/1999 Yates
5,937,193 A 8/1999 Evoy
5,946,487 A 8/1999 Dangelo
5,946,489 A 8/1999 Yellin
5,964,843 A 10/1999 Eisler
5,966,535 A 10/1999 Benedikt
5,967,894 A 10/1999 Kinoshita et al.
5,970,249 A 10/1999 Holzle
5,978,585 A 11/1999 Crelier
5,997,401 A 12/1999 Crawford
5,999,731 A 12/1999 Yellin
6,003,038 A 12/1999 Chen
6,015,346 A 1/2000 Bennett
D421,277 S 2/2000 McGahn et al.
6,021,272 A 2/2000 Cahill
6,021,273 A 2/2000 Criesemer
6,026,238 A 2/2000 Bond
6,029,000 A 2/2000 Woolsey
6,031,993 A 2/2000 Andrews
6,035,120 A 3/2000 Ravichandran
6,056,642 A 5/2000 Bennett
6,062,979 A 5/2000 Inoue
6,066,181 A 5/2000 DeMaster
6,071,192 A 6/2000 Weiss
6,074,432 A 6/2000 Guccione
6,075,940 A 6/2000 Gosling
6,089,976 A 7/2000 Schneider et al.
6,089,978 A 7/2000 Adams
6,092,147 A 7/2000 Levy
6,096,095 A 8/2000 Halstead
6,102,400 A 8/2000 Scott et al.
6,106,393 A 8/2000 Sunaga et al.
6,110,041 A 8/2000 Walker et al.
6,110,226 A 8/2000 Bothner
6,113,495 A 9/2000 Walker
6,117,009 A 9/2000 Yoseloff
6,126,165 A 10/2000 Sakamoto
6,138,273 A 10/2000 Sturges
6,141,794 A 10/2000 Dice
6,142,875 A 11/2000 Kodachi et al.
6,146,276 A 11/2000 Okuniewicz
6,155,925 A 12/2000 Giobbi et al.
6,159,097 A 12/2000 Gura
6,174,233 B1 1/2001 Sunaga et al.
6,174,235 B1 1/2001 Walker
6,175,632 B1 1/2001 Marx
6,217,448 B1 4/2001 Olsen
6,238,288 B1 5/2001 Walker et al.
6,241,612 B1 6/2001 Heredia
6,254,481 B1 7/2001 Jaffe
6,270,411 B1 8/2001 Gura et al.
6,302,790 B1 10/2001 Brossard
6,309,301 B1 10/2001 Sano
6,328,648 B1 12/2001 Walker et al.
6,390,923 B1 5/2002 Yoshitomi et al.
6,409,596 B1 6/2002 Hayashida et al.
6,416,411 B1 7/2002 Tsukahara
6,516,466 B1 2/2003 Jackson
6,537,152 B2 3/2003 Seelig et al.
6,544,122 B2 * 4/2003 Araki et al. ..... 463/35
6,554,703 B1 4/2003 Bussick et al.
6,561,908 B1 * 5/2003 Hoke ..... 463/35
6,599,195 B1 7/2003 Araki et al.
6,638,169 B2 10/2003 Wilder et al.
6,656,046 B1 12/2003 Yoseloff et al.
2002/0077165 A1 6/2002 Bansemer et al.
2002/0090990 A1 7/2002 Joshi et al.
2003/0064798 A1 4/2003 Attila et al.
2003/0064808 A1 4/2003 Hecht et al.
2003/0073489 A1 4/2003 Hecht et al.
2003/0073490 A1 4/2003 Hecht et al.
2003/0073491 A1 4/2003 Hecht et al.

OTHER PUBLICATIONS

Article, "Frankie & Annette's Beach Party Bally Gaming," published by Strictly Slots, Dec., 2001.

Article, "Megaman X's Soundcard History Museum," pp. 1–5, retrieved on May 11, 2000 on Internet at http://digitalparadise.cgocable.ca/Megaman_X/Soundcards.

Article, "Microprocessor Report," pp. 2, 12–17, published by Micro Design Resources on Mar. 25, 1996.

Article, "Monopoly Movers & Shakers Williams/WMS Gaming," published by Strictly Slots publication in Jul., 2000.

Brochure of Bally Gaming, Inc., "EVO Hybrid Frankie & Annette's Beach Party," published by Bally Gaming, Inc. in the year 2001 on or before Dec. thereof.

Brochure of Bally Gaming, Inc., "Frankie & Annette's Beach Party (EVO Hybrid)," http://www.ballygaming.com/gameroom/games.asp?gameID=664, Jan. 9, 2004.
Brochure of IGT, "Elephant King," http://www.igt.com/games/new_games/elephant.html, Mar. 21, 2001.
Brochure of IGT, "Leopard SPots, Double Diamond 2000, Little Green Men, Elephant King, I Dream of Jeannie," available in Oct., 1999.
Brochure of IGT, "Run for Your Money S–Plus Limited," published in the year 1998 on or before Dec. thereof.
Brochure of IGT, "Top Dollar S–Plus Limited," published in the year 1998 on or before Dec. thereof.
Brochure of IGT, "Totem Pole," written by IGT, available in the year 1997, on or before Dec. thereof.
Brochure of IGT, "Wheel of Fortune," published in the year 1998 on or before Dec. thereof.
Brochure of WMS Gaming Inc., "Meet the Next Generation of Monopoly Slot Machined from WMS Gaming!" published by Hasbro, Inc. in the year 1999 on or before Dec. thereof.
Brochure of WMS Gaming Inc., "Monopoly Chairman of the Board," published by Hasbro, Inc. in the year 1999 on or before Dec. thereof.
Brochure of WMS Gaming Inc., "Monopoly Once Around," published by Hasbro, Inc. in the year 1998 on or before Dec. thereof.
Brochure of WMS Gaming Inc., "Monopoly Reel Estate," published by Hasbro, Inc. in the year 1998 on or before Dec. thereof.
Brochure of WMS Gaming Inc., "Movers & Shakers," published by Hasbro, Inc. in the year 2000 on or before Dec. thereof.
Chutes and Ladders CD–ROM Game, Hasbro Interactive, Inc., available in the year 1999 on or before Dec. thereof.
Description of Lighting Features in Gaming Machines, written by IGT, available in the year 1999 on or before Dec. thereof.
Description of Maximum Wager Sound and Bet Sounds in Gaming Devices written by IGT, available in the year 2000 on or before Dec. thereof.
MIDI Media Adaptation Layer for IEEE–1394, published by the Association of Musical Electronics Industry in Tokyo, Japan and The MIDI Manufacturers Association in Los Angeles, California, Nov. 30, 2000, pp. 1–17.
Press Release by Ian Fried of CNET News.com, "Microsoft Releases XP for Slot Machines," file:// C:WINDOW...\Microsoft releases XP for slot machines—Tech News—CNET.com.htm., Nov. 28, 2001, pp. 1–2.
Press Release, "WMS Gaming's Monopoly Slot Machines Named 1998's Most Innovative Gaming Product At The American Gaming, Lodging and Leisure Summit," published by WMS Gaming Inc. on Jan. 13, 1999.
Screen Shot and Description by IGT of "Free Spins Bonus (Elephant King)" written by IGT, available in Oct., 1999.
Screen Shots of "Race Car Bonus Feature" written by IGT, available in the year 1998 on or before Dec. thereof.
The Java™ Tutorial, "What Can Java Technology Do?" http://java.sun.com/docs/books/tutorial/getStarted/i.../definition.htm, Oct. 16, 2000, pp. 1–2.
The MIDI File Format, http://crystal.capana.org.au/ghansper/midi_introduction/midi_file_format.html, Dec. 28, 2001, pp. 1–10.
Description of Maximum Wager Sound and Bet Sounds in Gaming Devices written by IGT, available prior to 2000.
Description of Sound Feature in Totem Pole™ Gaming Machine written by IGT, available in 1997.
Description of Tempo Change In Gaming Machines written by IGT, available prior to 2001.
Description of Volume Control Functions in Gaming Machines written by IGT, available prior to 2000.
Description of Last Sound in Credit Roll–Up in Gaming Machines written by IGT, available prior to 2001.
Description of Sound Effects in Gaming Devices written by IGT, available prior to 2001.
Description of Verbal Wager Feature in "Dick Clark" Gaming Machine written by IGT, available in 2000.
Description of Accelerated Credit Roll–Up in Gaming Machines written by IGT, available prior to 2000.
Description of Payout SOund Feature in Gaming Machine written by IGT, available prior to 2000.
Description of Progressive Sound Feature in Pinball and Video Games written by IGT, available prior to 2000.
Description of Action Prompts in Gaming Machines, written by IGT, available prior to 2000.

* cited by examiner

FIG. 3A

| GAME EVENT | PRIMARY SOUND RECORDING |
|---|---|
| PLAY OF PRIMARY GAME | A |
| PLAY OF BONUS ROUND | B |

FIG. 3B

| PRIMARY SOUND RECORDING | VARIANT SOUND RECORDINGS |
|---|---|
| A | A1, A2, A3, A4 |
| B | B1, B2, B3, B4 |

FIG. 3C

| PLAYER INPUT EVENT | VARIANT SOUND RECORDING |
|---|---|
| 1ST PUSH OF PLAY BUTTON | A-1 OR B-1 |
| 2ND PUSH OF PLAY BUTTON | A-2 OR B-2 |
| 3RD PUSH OF PLAY BUTTON | A-3 OR B-3 |
| 4TH PUSH OF PLAY BUTTON | A-4 OR B-4 |
| 1ST PUSH OF BET INCREASE BUTTON | A-2 OR B-2 |
| 2ND PUSH OF BET INCREASE BUTTON | A-4 OR B-4 |
| PUSH OF CASH-OUT BUTTON | A-4 OR B-4 |
| ••• | ••• |
| ••• | ••• |

FIG. 4A

| CHANGE IN KEY OF SONG (ORIGINAL KEY: C) | |
|---|---|
| PLAYER INPUT | KEY |
| W | KEY D |
| X | KEY E |
| Y | KEY F |
| Z | KEY G |

FIG. 4B

| CHANGE IN TEMPO OF SONG | |
|---|---|
| PLAYER INPUT | TEMPO |
| W | 10% INCREASE IN ORIGINAL TEMPO |
| X | 20% INCREASE IN ORIGINAL TEMPO |
| Y | 30% INCREASE IN ORIGINAL TEMPO |
| Z | 40% INCREASE IN ORIGINAL TEMPO |

FIG. 4C

| CHANGE IN STYLE OF SONG (ORIGINAL STYLE: SWING) | |
|---|---|
| PLAYER INPUT | STYLE |
| W | BOSSA NOVA |
| X | JAZZ |
| Y | ROCK |
| Z | COUNTRY |

FIG. 4D

| CHANGE IN MELODY OF SONG (ORIGINAL MELODY: A) | |
|---|---|
| PLAYER INPUT | MELODY |
| W | MELODY B |
| X | MELODY C |
| Y | MELODY D |
| Z | MELODY E |

GAMING DEVICE WITH SOUND RECORDING CHANGES ASSOCIATED WITH PLAYER INPUTS

This application is related to the following commonly-owned patent applications: "Gaming Device With Award and Deduction Proximity-Based Sound Effect Feature," Ser. No. 09/656,663,; "Gaming Device and Method for Enhancing the Issuance or Transfer of an Award," Ser. No. 09/583,482, now U.S. Pat. No. 6,769,985; "Gaming Device Providing Audio Wagering Information," Ser. No. 09/629,288, "Gaming Device Having Changed or Generated Player Stimuli," Ser. No. 09/686,244, now U.S. Pat. No. 6,739,973; "Gaming Device With a Metronome System for Interfacing Sound Recordings," Ser. No. 09/687,692, now U.S. Pat. No. 6,561,908; "Gaming Device With Sound Recording Changes Associated With Player Inputs," Ser. No. 09/978,607, and "Gaming Device Having Pitched-Shifted Sound and Music," Ser. No. 09/978,795.

BACKGROUND OF THE INVENTION

Contemporary gaming machines, such as slot machines, video poker machines, video blackjack machines and video keno machines, include a primary game and one or more bonus rounds or bonus games. Most of these gaming machines include computer systems which generate sounds, such as music at various times during the primary games, bonus games and attract modes. These gaming machines typically initiate the play of sound recordings when certain game events occur, such as a player winning a value or reaching a bonus round.

There are no known gaming devices which produce a sound recording when a game event occurs and then when a player makes a predetermined input, change that sound recording with a variant of that sound recording or with a different sound recording. To increase player enjoyment and excitement, it is desirable to provide players with new gaming machines which have new and more interesting sound functions.

SUMMARY OF THE INVENTION

The present invention overcomes the above shortcomings by providing a gaming device which, in one embodiment, produces a sound recording, preferably background or game music, at a particular time and then produces a musical change in that sound recording or a different sound recording when a player makes a predetermined input, such as pushing a bet button. The player can make an input in the gaming device by using any player input device. In one embodiment, the player selects certain wager options (e.g., bet, play or cashout) by using the input device. A player input device includes any mechanical, electromechanical, electric or electronic device or component, sensor or system which enables the player to provide one or more signals to the gaming device, including, without limitation, buttons, dials, wheels, touch screens, mouses, joysticks, track balls and voice sensors or other activators.

When the gaming device makes a sound recording change in response to a player input, the gaming device alters the entire sound recording or one or more of the musical variables of that sound recording. A musical variable can include, but is not limited to, any changeable factor which affects the sound or quality of a sound recording, including, without limitation, musical key, musical tempo, musical style, musical melody, musical jump to a different section of a song or composition, musical beat, upbeat changes, downbeat changes, musical keys, musical notes, musical chords, musical sample rate, musical pitch, musical crescendo singing voice (e.g., a change from the voice of one singer to the voice of a different singer), syncopation, mode, scale or instrument. A musical skip can include a change or skip from one section of a sound recording to a different section of the sound recording.

In one embodiment, the gaming device makes the sound recording change by automatically editing a sound file using a suitable editor program. In one preferred embodiment, the gaming device plays a pre-stored variant sound file as it stops playing the initial, primary or previous sound file. The term "variant sound file" or "variant sound recording," as used herein, include any sound file or sound recording which is a different sound file or sound recording or a variation of another sound file or sound recording. A variant sound file can be a variation of an original primary sound file, or a variant sound file can be a variation of another variant sound file.

In one embodiment, the sound system of the present invention includes a central processing unit (CPU), a memory device or data storage device for storing program code or other data and a sound card. The sound card includes sound random access memory (RAM) which includes one or more primary sound files and one or more variant sound files associated with the primary sound files.

The data storage device, which is accessed by the CPU, includes game read only memory (ROM) and game random access memory (RAM). The game ROM includes game code, music code and sound change code. The game code includes instructions which control the gaming device so that it plays one or more particular games in accordance with applicable game rules and pay tables. The music code includes a set of instructions which the CPU uses to determine the type, duration, and volume of the sound recordings to be played.

The sound change code includes instructions which direct the CPU how to generate, store, interpret and use the data stored in sound change random access memory (RAM). Specifically, the sound change code includes instructions which direct the CPU to: (a) play a primary sound recording when a predetermined game event or input event occurs; (b) play a variant sound recording (stored in a variant sound file) when a player makes a predetermined input; and (c) stop the primary sound recording. The particular primary sound recordings and variant sound recordings which the CPU plays can be predetermined or randomly determined.

The sound change code defines an association of: (a) predetermined events (game events or input events) to primary sound recordings; and (b) predetermined player input events to variant sound recordings. The sound change RAM, included within the game RAM, includes game event data and player input data. The game event data is generated by the CPU when a sound-causing event occurs before, during or after a game. Any predetermined event can be a sound-causing event, including, without limitation, the initiation of a game, a player gaining value or losing value, the triggering of a bonus round, the ending of a game, a player input or the initiation of any predetermined game mode or state.

Preferably, each type of sound-causing event is associated with certain game event data or player input data. The CPU reads and uses this data to start a sound recording or make a particular sound change at the appropriate time. For example, when a player selects a symbol by touching a screen, the CPU generates, reads and uses player input data to cause a particular sound change to occur.

When the CPU changes from playing one sound recording to another, the CPU can stop the first sound recording at one point in time and start the second sound recording at the same point in time in a seamless manner to the player. The CPU can also fade-out the first sound recording and the simultaneous play or fade-in the second sound recording. Alternatively, the CPU can play a transitional sound recording to produce a musical transition from the first sound recording to the second sound recording.

Furthermore, when the CPU makes a change from playing an initial sound recording to a variant of that sound recording, the change can be timed so that the transition is not on-beat, or the change be timed so that the variant sound recording is generated on-beat with the initial sound recording. In the latter case, the gaming device, in one embodiment, can include any suitable metronome program or other program which the CPU uses to make sound changes on-beat.

It should be understood that the sound change of the present invention can be a change from a primary sound recording to a variant of that sound recording, or the sound change can be a change from one variant sound recording to another variant sound recording, as long as the second variant sound recording is a variant of the first variant sound recording or else both of the variant sound recordings are variations of a common primary sound recording.

The gaming device of the present invention, in one embodiment, plays a primary sound recording when a particular event occurs, and when a player makes a predetermined input, the gaming device plays a variant sound recording and ends the primary sound recording. The variant sound recording is a variation of the primary sound recording For example, the primary sound recording may be a song played in musical key C, and the variant sound recording may be the same song played in the musical key F. This type of gaming device increases the entertainment and enjoyment experienced by gaming device players.

The present invention, in one embodiment, provides a plurality of musical changes associated with different player inputs. Depending upon which input a player makes, the gaming device plays or produces different musical recordings. The different musical recordings may be completely different music or changes in the music being played, such as a change in style (e.g., swing to bossa nova), change in the key, change in the tempo, change in the melody or jump to a different section of a song.

It is therefore an object of the present invention to provide a gaming device with sound recording changes associated with player inputs.

Another object of the present invention is to provide a gaming device which plays a sound recording in a predetermined mode and then changes a musical variable in that sound recording when a player makes a predetermined input.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 3A is a table showing example game events and associated primary sound recordings in one embodiment of the present invention.

FIG. 3B is a table showing example primary sound recordings and associated variant sound recordings.

FIG. 3C is a table showing example player input events and associated variant sound recordings.

FIGS. 4A to 4D are tables showing examples of various sound changes resulting from various player inputs in various embodiments of the present invention.

DETAILED DESCRIPTION OF THE INVENTION

Gaming Device Structure

Figure 1A:
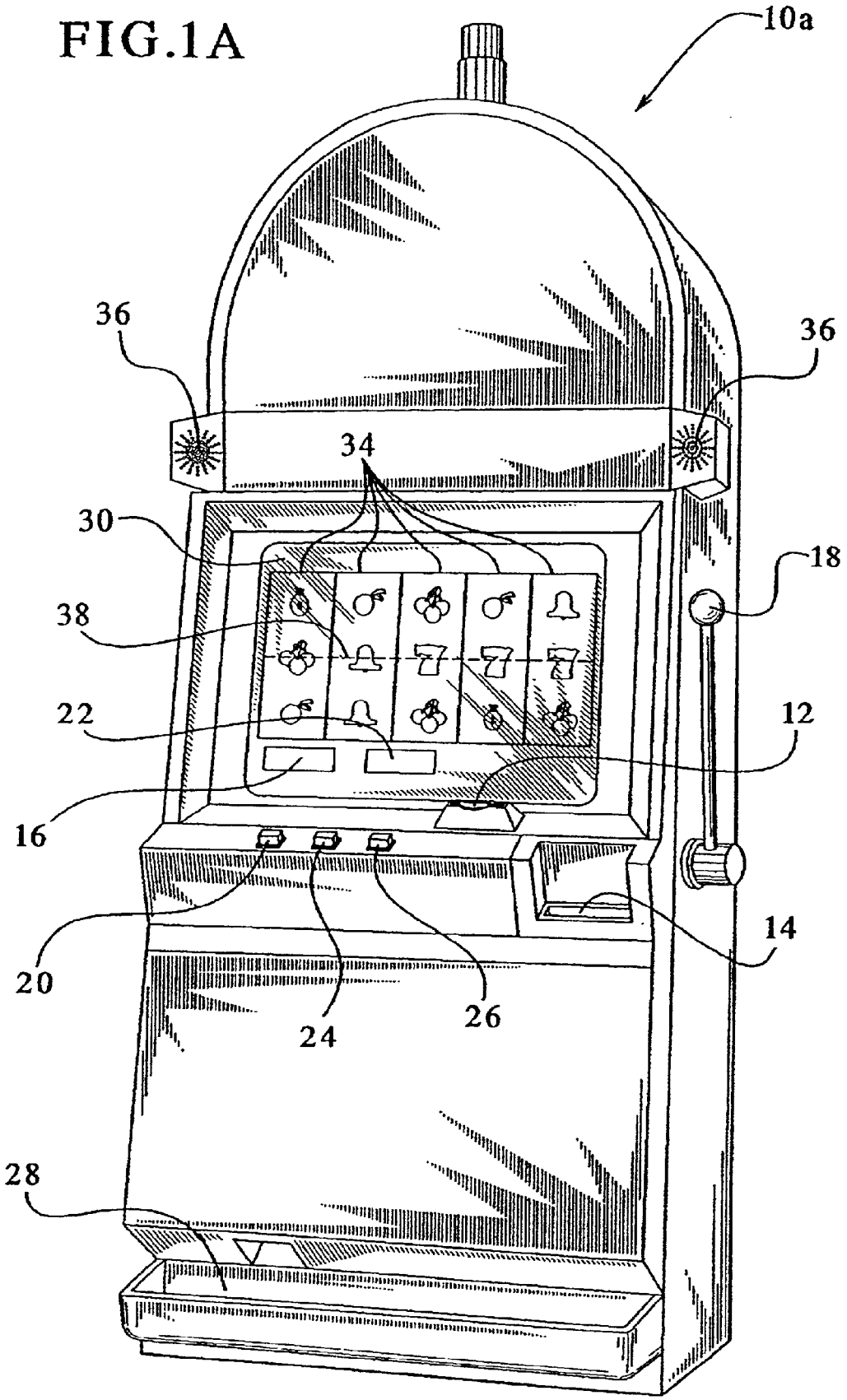
FIG. 1A is a perspective view of one embodiment of the gaming device structure of the present invention.
Figure 1B:
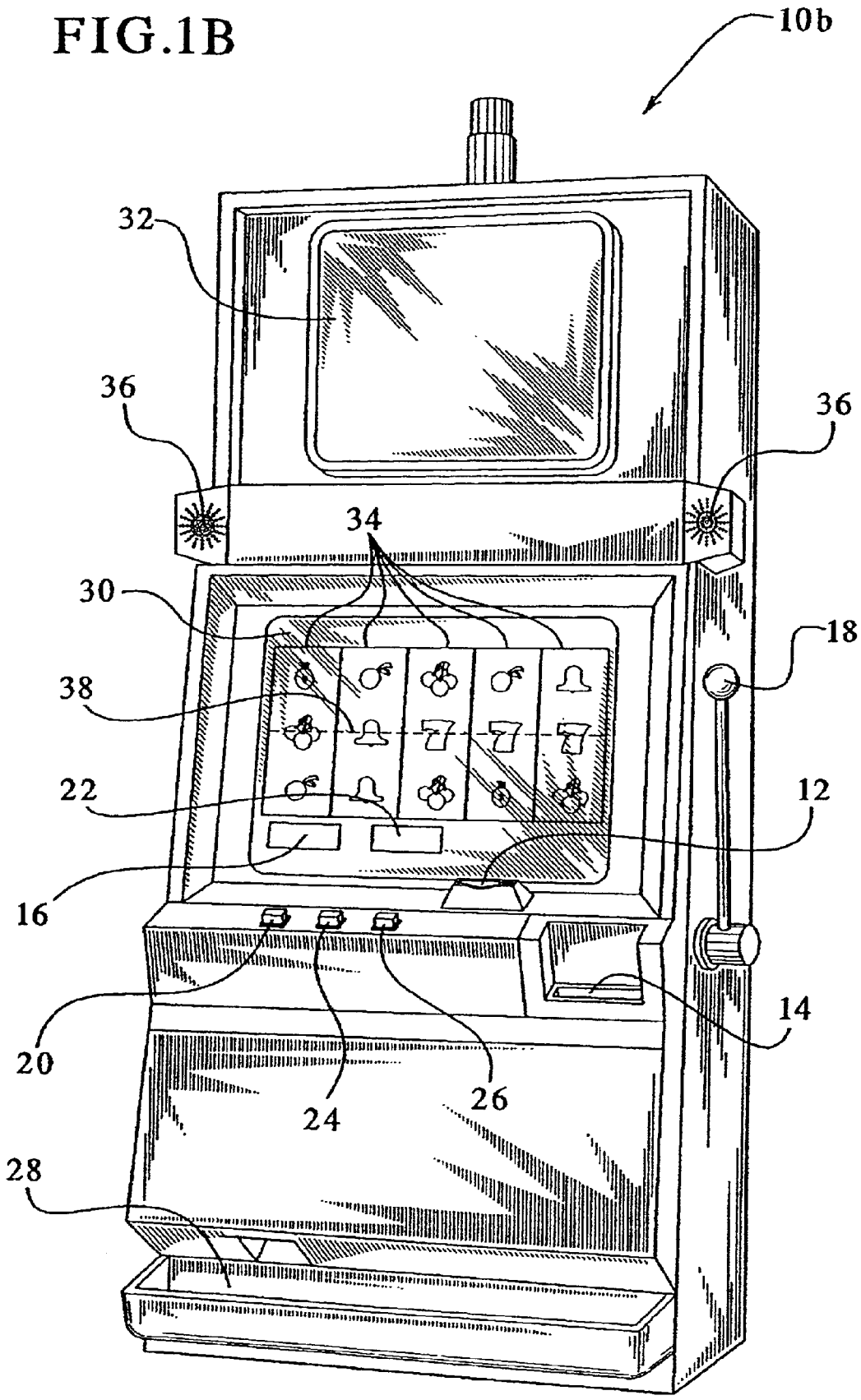
FIG. 1B is a perspective view of another embodiment of the gaming device structure of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10, in one embodiment, is a slot machine having the controls, displays and features of a conventional slot machine. It is constructed so that a player can operate it while standing or sitting, and gaming device 10 is preferably mounted on a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device which is capable of producing sounds. Also, gaming device 10 can be implemented as a program code stored on a disk or other memory device which a player can use in a desktop or laptop personal computer or other computerized platform which is capable of producing sounds.

Gaming device 10 can incorporate any primary game such as slot, poker, blackjack or keno, any of their bonus triggering events and any of their bonus round games. The symbols and indicia used on and in gaming device 10 may be in mechanical, electronic, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. In one embodiment, gaming device 10 displays a plurality of reels 34, such as three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 includes speakers 36 for making sounds or playing music, as described in more detail below.

With reference to FIGS. 1A and 1B, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 may use a video-based central display device 30 to enable the player to play the bonus round. The qualifying condition may, for instance, be a predetermined combination of indicia appearing on a plurality of reels 34. As illustrated in the five reel slot game shown in FIGS. 1A and 1B, the qualifying condition could be the number seven appearing on three adjacent reels 34 along a payline 38. It should be appreciated that the present invention can include one or more paylines, such as payline 38, wherein the paylines can be horizontal, diagonal or any combination thereof.

Sound System

The gaming device of the present invention includes a sound system embodied in one or more computer systems used to operate the gaming device. The sound system includes a particular configuration of sound-specific memory which can be incorporated into any computer system of any gaming device, including, but not limited to, systems which operate in gaming devices locally and systems which remotely operate one or more gaming devices through one or more networks.

Figure 2:
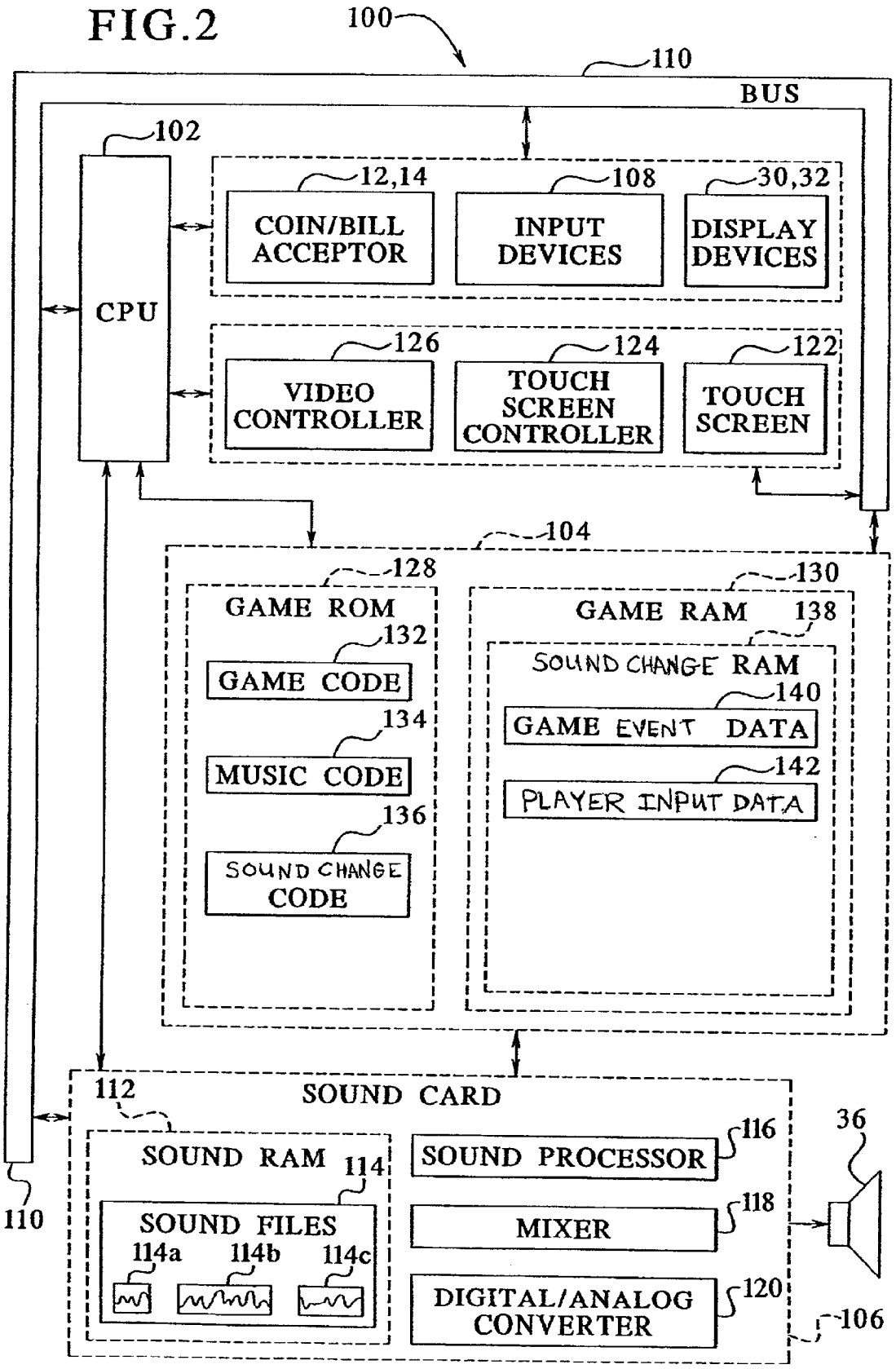
FIG. 2 is a schematic block diagram of the sound system of one embodiment of the gaming device of the present invention.

With reference to FIG. 2, in one embodiment the sound system 100 includes: a central processing unit (CPU) 102; a memory device or data storage device 104 for storing program code or other data; and a sound card 106. This embodiment also includes a coin slot 12 or bill acceptor 14; central display device 30; an upper display device 32; a plurality of speakers 36; and one or more input devices 108. All of these components electronically communicate with one another through a bus 110.

Sound card 106 includes sound random access memory (RAM) 112 which includes a plurality of sound files 114, identified as 114*a*, 114*b* and 114*c*. Sound files 114 can include any type of sound file readable by the CPU 102. Preferably, sound files 114 include digital wave files for musical sound recordings and sound effect recordings. As described below, sound files 114 preferably include a plurality of primary sound files (which store background music and other game music) as well as variant sound files associated with the primary sound files. In addition, sound card 106 includes a sound processor 116 which drives a mixer 118 and an analog to digital converter 120, thereby causing speakers 36 to generate sound. Mixer 118 enables the sound processor 116 to vary the volume of the sound recordings.

As illustrated in FIG. 2, the player preferably uses the player input devices 108, such as pull arm 18, play button 20, the bet one button 24 and the cash out button 26 to input signals into gaming device 10. It should be appreciated though, that player input devices can include other buttons (such as a bet button, repeat button, line button, wager per line button, help button or change button) touch screens, dials, wheels, mouses, joysticks, track balls, voice sensing devices and other suitable input devices. The player can use these input devices to exercise or select certain wager options, such as whether to make a bet, increase a bet, play a hand, spin reels or cash out.

In the case of a touch screen, it is preferable to use a touch screen 122 and an associated touch screen controller 124 instead of a conventional video monitor display device. Touch screen 122 and touch screen controller 124 are connected to a video controller 126 and CPU 102. A player can make decisions and input signals into the gaming device 10 by touching touch screen 122 at the appropriate places in a conventional manner. When a player generates an input signal with a player input device, a player input event occurs. When CPU 102 reads the player input events, CPU 102 causes certain sound changes, as described below.

CPU 102 is preferably a microprocessor or microcontroller-based platform which is capable of displaying images, symbols and other indicia such as images of people, characters, places, things and faces of cards. The data storage device 104, communicating with CPU 102, includes game read only memory (ROM) 128 and game random access memory (RAM) 130, which at times communicate with one another.

Game ROM 128 includes game code 132, music code 134 and sound change code 136. Game code 132 includes instructions which control the gaming device 10 so that it plays one or more particular games in accordance with applicable game rules and pay tables. The music code 134 includes a set of instructions which the CPU 102 uses to determine the type, duration, and volume of sound recordings to be played. Preferably, the music code 134 is a commercially available code such as music instrument digital interface (MIDI).

Sound change code 136 includes instructions which direct the CPU 102 how to generate, store, interpret and use the data stored in sound change random access memory (RAM) 138. Specifically, sound change code 136 includes instructions which direct the CPU 102 to: (a) play a primary sound recording when a predetermined game event or input event occurs; (b) play a variant sound recording when a player makes one of a plurality of predetermined inputs; and (c) stop the primary sound recording. The particular primary sound recordings and variant sound recordings which CPU 102 plays may be predetermined. Alternatively, CPU 102 can randomly determine which primary sound recording and variant sound recording to play, preferably through use of a random outcome generator.

As illustrated in FIGS. 3A to 3C, the instructions of sound change code 136 relate or associate game events or input events with primary sound recordings, and the instructions further associate each primary sound recording with one or more variant sound recordings. Furthermore, the instructions of sound change code 136 relate or associate player input events with one or more of the variant sound recordings.

Sound change RAM 138, included within the game RAM 130, includes game event data 140 and player input data 142. Sound change RAM 138 temporarily stores all of this data, preferably in the form of buffer memory. It should be appreciated that the present invention can be adapted so that the sound change RAM 138 can include other types of data which relate to the characteristics or quality of one or more sound recordings.

The game event data 140 is data generated by the CPU 102 when a sound-causing event occurs in a game. Any predetermined event can be a sound-causing event. In one embodiment, a sound-causing event occurs when the game starts, a player gains value or loses value, a bonus round is triggered or when the game ends. Sound-causing events can also occur when the player makes a selection, activates an input device 108 or other activator or makes an advancement or progress in a game or for any other reason.

Preferably, each type of sound-causing event is associated with certain game event data 140 or player input data 142. Event data 140 and input data 142 preferably include flag data. The flag data flags or directs the CPU 102 to start a sound recording or make a particular sound change, as described in detail below. The player input data 142 is the data which CPU 102 generates when the player makes a predetermined input.

CPU 102 reads the data in game RAM 130, and using game ROM 128, CPU 102 plays certain sounds and causes certain sound changes to occur. Referring back to FIGS. 3A to 3C, in this illustrated example the gaming device plays sound recording A during the play of a primary game, and the gaming device plays sound recording B during the play of a bonus round game. Sound recording A is associated with a group of sound recording variants A1, A2, A3 and A4, and sound recording B is associated with a group of sound recording variants B1, B2, B3 and B4. These variants can include variations, for example, in the musical key, tempo, style, melody or any other predetermined musical variable. In this example, during the play of the primary sound recording A in the primary game, the player pushes a play button, and the gaming device then plays variant sound recording A1 and stops playing primary sound recording A. During the play of primary sound recording B in the bonus round game, the player pushes a button to increase his/her bet, and the gaming device then plays variant sound recording B2 and stops playing primary sound recording B.

Depending upon the predetermined programming of the sound change code 136, the gaming device can change play from any predetermined primary sound recording to any variant sound recording or from a variant sound recording associated with one primary sound recording to another variant sound recording associated with the same primary sound recording.

The change in play from one sound recording to another can include any suitable change in any musical variable. In the examples illustrated in FIGS. 4A to 4D, the change involves change in musical key, tempo, style and melody, respectively. In the example illustrated in FIG. 4A, when the gaming device is playing a predetermined song in key C, if a player makes input W, the gaming device plays the same song in key D and then stops playing the song in key C. In the example illustrated in FIG. 4B, when the gaming device is playing a predetermined song in a predetermined tempo, if a player makes input Y, the gaming device plays the same song in a tempo increased by thirty percent and then stops playing the song in the original tempo. In the example illustrated in FIG. 4C, when the gaming device is playing a predetermined song in a swing style, if a player makes input W, the gaming device plays the same song in a bossa nova style and then stops playing the song in the swing style. In the example illustrated in FIG. 4D, when the gaming device is playing a predetermined song in a melody A, if a player makes input Z, the gaming device plays the same song in a melody E and stops playing the song in the melody A.

When the CPU changes from playing one sound recording to another, the CPU can stop the first sound recording at one point in time and start the second sound recording at the same point in time (e.g., simultaneously). The CPU can also fade-out the first sound recording and play or fade-in the second sound recording. Alternatively, the CPU can play a transitional sound recording to produce a musical transition from the first sound recording to the second sound recording.

In addition, when the CPU makes a change from playing an initial sound recording to a variant of that sound recording, the change can be timed so that the transition is not on-beat, or the change be timed so that the variant sound recording is generated on-beat with the initial sound recording. In the latter case, the gaming device, in one embodiment, can include a suitable software metronome or metronome program which the CPU uses to make sound changes on-beat. Here, the CPU reads game state data on code-driven metronome ticks determined by a predetermined check-back rate. Using the check-back rate, the CPU detects sound-causing events and simultaneously plays a new sound recording on-beat with an initial recording.

Although the change in sound is often described herein as a change from a primary sound recording to a variant sound recording, it should be appreciated that the change can also be a change from one variant sound recording to another variant sound recording, as long as the second variant sound recording is a variation of the first variant sound recording or else both of the variant sound recordings are variations of a common primary sound recording. The sound change of the present invention, in response to player inputs, can also include a change from one primary sound recording to an entirely different sound recording (e.g., from "Silent Night" to "White Christmas").

In one embodiment, the gaming device of the present invention performs sound changes to indicate or emphasize an input which a player makes during a game state or game mode, such as an attract mode, idle mode, normal mode, game play mode, bonus mode, cashout mode, credit roll-up mode, jackpot mode, or any hand pay modes or player tracking modes. Here, each such mode comprises an event which is associated with a predetermined primary sound recording. When such a mode event occurs, the CPU plays a predetermined primary sound recording. When a player makes a predetermined input while the primary sound recording is playing, the CPU plays a variant of the primary sound recording.

In one alternative embodiment of the present invention, the gaming device does not include game event data for the purpose of triggering the play of primary sound files. Rather, a player causes the CPU to play a primary sound file by making a predetermined player input. In this embodiment certain player input events are associated with primary sound files and other player input events are associated with variant sound files. In operation of one example, a player may cause a primary sound file to play by depositing currency in the gaming device. The player may then cause a variant sound file to play by later pushing a bet button.

In another alternative embodiment of the present invention, the gaming device does not include sound change code, but instead includes a database or data tables which store game event data, primary sound recording data, variant sound recording data and player input event data, all in relational relationship with one another. In this embodiment, the data is organized so that: (a) different types of game events or input events are associated with different primary sound recordings; (b) the primary sound recordings are each associated with one or more variant sound recordings; and (c) different types of player inputs are associated with certain variant sound recordings.

In another alternative embodiment of the present invention, instead of the gaming device being pre-loaded with the variant sound files, the CPU can dynamically generate variant sound files or alter primary sound files on the fly when a player makes a predetermined input. A suitable editor computer program could instruct the gaming device to perform either of such functions during operation of the game, preferably in real-time.

It should be appreciated that although a CPU 102 and data storage device 104 are preferable implementations of the present invention, the present invention can also be implemented using one or more application-specific integrated circuits (ASIC's) or other hard-wired devices, or using mechanical devices. Furthermore, although the CPU 102 and data storage device 104 preferably reside on each gaming device unit, it is possible to provide some or all of their functions at a central location such as a network server for communication to a playing station such as over a local area network (LAN), wide area network (WAN), Internet connection, microwave link, and the like.

The gaming device of the present invention includes a sound system which enables the gaming device to play an initial sound recording and to then play a variant of that sound recording when a player makes a predetermined input. Such a gaming device increases the entertainment and enjoyment experienced by gaming device players.

In one embodiment, the gaming device of the present invention includes a computer which stores background music or other game music, a plurality of musical changes to this music and a plurality of wager options for a player. The computer plays the background music at a particular time and enables a player to select a wager option. Depending upon which wager option a player selects (such as bet increase, play or cashout), the computer makes different musical changes to the game music (such as change in key or tempo).

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device having a wager game, comprising:

at least one data storage device storing a plurality of instructions associated with a plurality of different functions of the wager game;

at least one primary sound file stored in the data storage device;

a plurality of variant sound files stored in the data storage device, each of the variant sound files being a variation of the primary sound file and each of the variant sound files being different from one another, wherein the variation between the primary sound file and each of the variant sound file is at least a change in a music variable selected from the group consisting of key, tempo, style, melody, beat, syncopation, notes, mode, scale, chords, pitch, voice, instrument and a jump from one section of a sound recording to a different section of said sound recording;

a plurality of different options selectable by the player, at least two of the options associated with: (a) a different one of the variant sound files; and (b) a different one of the functions of the wager game;

at least one speaker;

at least one player input device enabling the player to select the options; and a processor in communication with the data storage device, the player input device and the speaker, which: (a) plays the primary sound file after a predetermined event occurs; (b) determines which one of the options is selected by the player; (c) plays any variant sound file associated with the selected option; and (d) operates the wager game according to the function associated with the selected option.

2. The gaming device of claim 1, which includes at least one game event stored in the data storage device.

3. The gaming device of claim 2, wherein the predetermined event is the game event.

4. The gaming device of claim 1, which includes a plurality of player input events stored in the data storage device.

5. The gaming device of claim 4, wherein the predetermined event includes one of a plurality of player input events.

6. The gaming device of claim 1, wherein the predetermined event is initiation of a predetermined game mode.

7. The gaming device of claim 6, wherein the game mode is selected from the group consisting of an attract mode, an idle mode, a normal mode, a game play mode, a bonus mode, a cashout mode, a credit roll-up mode, a jackpot mode, a hand pay mode and a player tracking mode.

8. A gaming device having a wager game, comprising:

at least one data storage device storing a plurality of instructions associated with a plurality of different functions of the wager game;

at least one primary sound file stored in the data storage device;

a plurality of variant sound files stored in the data storage device, each of the variant sound files being a variant of the primary sound file and each of the variant sound files being different from one another, wherein the variation between the primary sound file and each of the variant sound files is at least a change in a music variable selected from the group consisting of: key, tempo, style, melody, beat, syncopation, notes, mode, scale, chords, pitch, voice, instrument and a jump from one section of a sound recording to a different section of said sound recording;

a plurality of different options selectable by the player, at least two of the options associated with (a) a different one of the variant sound files; and (b) a different one of the functions of the wager game;

at least one speaker;

at least one player input device enabling the player to select the options; and a processor in communication with the data storage device, the player input device and the speaker, which: (a) plays the primary sound file after a designated event associated with said primary sound file occurs; (b) determines which one of the options is selected by the player; (c) plays any variant sound file associated with the selected option; and (d) operates the wager game according to the function associated with the selected option.

9. A gaming device having a wager game, comprising:

at least one data storage device storing a plurality of instructions associated with a plurality of different functions of the wager game;

at least one primary sound file stored in the data storage device;

a plurality of variant sound files stored in the data storage device, each of the variant sound files being a variant of the primary sound file and each of the variant sound files being different from one another, wherein the variation between the primary sound file and each of the variant sound files is at least a change in a music variable selected from the group consisting of: key, tempo, style, melody, beat, syncopation, notes, mode, scale, chords, pitch, voice, instrument and a jump from one section of a sound recording to a different section of said sound recording;

at least one game event stored in the data storage device, the game event associated with the primary sound file;

a plurality of different options selectable by the player, at least two of the options associated with: (a) a different one of the variant sound files; and (b) a different one of the functions of the wager game;

at least one speaker;

at least one player input device enabling the player to select the options; and a processor in electronic communication with the data storage device, the player input device and the speaker, which: (a) plays the primary sound file after the game event associated with said primary sound file occurs; (b) determines which one of the options is selected by the player; (c) plays any variant sound file associated with the selected option; and (d) operates the wager game according to the function associated with the selected option.

10. A gaming device having a wager game, comprising:

at least one data storage device storing a plurality of instructions associated with a plurality of different functions of the wager game;

at least one primary sound file stored in the data storage device;

a plurality of variant sound files stored in the data storage device, each of the variant sound files being a variant of the primary sound file and each of the variant sound files being different from one another, wherein the variation between the primary sound file and each of the variant sound files is at least a change in a music variable selected from the group consisting of: key, tempo, style, melody, beat, syncopation, notes, mode, scale, chords, pitch, voice, instrument and a jump from one section of a sound recording to a different section of said sound recording;

a plurality of different options selectable by the player, at least two of the options associated with (a) a different one of the variant sound files; and (b) a different one of the functions of the wager game;

at least one speaker;

at least one player input device enabling the player to select the options; and a processor in electronic communication with the data storage device, the player input device and the speaker, which: (a) plays the primary sound file after a predetermined event occurs; (b) determines which ones of the options are selected by the player; (c) plays any of the variant sound files associated with the selected options; and (d) operates the wager game according to the functions associated with the selected options.

11. A method of providing a sound change in a gaming device, said method comprising the steps of:

initiating a predetermined game mode of a wager game;

playing a primary sound file;

associating a plurality of variant sound files with the primary sound file, each of the variant sound files being a variation of the primary sound file and each of the variant sound files being different from one another;

receiving a selection by a player of one of a plurality of different options;

associating at least two of the options with: (a) a different one of the variant sound files; and (b) a different function of the wager game;

determining which one of the options is selected by the player;

playing any variant sound file associated with the selection option, wherein said variant sound file is at least a change in a music variable selected from the group consisting of: key, tempo, style, melody, beat, syncopation, notes, mode, scale, chords, pitch, voice, instrument and a jump from one section of a sound recording to a different section of said sound recording; and operating the wager game according to the function associated with the selection option.

12. The method of claim 11, wherein the variation includes a musical change to said primary sound file.

13. The method of claim 12, wherein the step of playing the variation includes the step of playing a sound file which includes a musical change to said primary sound file.

14. A method of providing a sound change in a gaming device, said method comprising the steps of:

initiating a predetermined game mode of a wager game;

playing a musical sound recording;

enabling a player to select one of a plurality of different options associated with different functions of the wager game;

receiving the player's selection of one of the options; and changing a musical variable in said musical sound recording, said change depending upon the option selected by the player wherein said step of changing the musical variable at least includes the step selected from the group consisting of: changing key, changing tempo, changing style, changing melody, changing beat, changing syncopation, changing notes, changing mode, changing scale, changing chords, changing pitch, changing voice, changing instrument and jumping from one section of a sound recording to a different section of said sound recording; and continuing to play the changed musical sound recording until a predetermined event occurs.

15. The method of claim 14, wherein enabling the player to select one of a plurality of different options includes providing the player with the opportunity to perform at least one of the steps selected from the group consisting of placing a bet, initiating a play, cashing out, increasing a bet, changing a wager, playing a hand and spinning one or more reels.

16. A data storage device for a gaming device, said data storage device comprising:

a memory device storing a plurality of instructions associated with a plurality of different functions of the wager game;

at least one primary sound file stored in the memory device;

a plurality of variant sound files stored in the memory device, each of the variant sound files being a variation of the primary sound file and each of the variant sound files being different from one another, wherein the variation between the primary sound file and each of the variant sound files is at least a change in a music variable selected from the group consisting of: key, tempo, style, melody, beat, syncopation, notes, mode, scale, chords, pitch, voice, instrument and a jump from one section of a sound recording to a different section of said sound recording;

a plurality of different options selectable by the player, at least two of the options associated with: (a) a different one of the variant sound files; and (b) a different one of the functions of the wager game;

at least one player input device enabling the player to select the options; and a plurality of instructions for a processor, said instructions directing the processor to: (a) play the primary sound file after a predetermined event occurs; (b) determine which one of the options is selected by the player; (c) play any variant sound file associated with the selected option; and (d) operate the wager game according to the function associated with the selected option.

17. A gaming device having a wager game having a plurality of different functions, the gaming device comprising:

a plurality of different options selectable by a player, each of the options associated with a different one of the functions of the wager game;

a plurality of musical recordings;

a data storage device which stores the options and musical recordings;

means for enabling the player to select the options; and a processor in communication with the data storage device and the player input means, which: (a) plays one of the musical recordings after a particular event occurs; (b) determines which one of the options is selected by the player; and (c) plays a variation of said musical recording after a player makes a predetermined player input, the variation played depending upon the option selected by the player wherein said variation of said musical recording is at least a change in a music variable selected from the group consisting of: key, tempo, style, melody, beat, syncopation, notes, mode, scale, chords, pitch, voice, instrument and a jump from one section of a sound recording to a different section of said sound recording.

18. A gaming device having a wager game having a plurality of different functions, the gaming device, comprising:

a plurality of musical recordings;

a plurality of musical variations to each of the musical recordings, each of the musical variations being different than one another, wherein the variations to the musical recordings include at least a change in a music variable selected from the group consisting of: key, tempo, style, melody, beat, syncopation, notes, mode, scale, chords, pitch, voice, instrument and a jump from one section of a sound recording to a different section of said sound recording;

a plurality of different options selectable by a player, at least two of the options associated with: (a) a different one of the musical variations; and (b) a different one of the functions of the wager game;

a data storage device which stores the options, musical recordings and the musical variations;

means for enabling the player to select the options; and a processor in communication with the data storage device and the player input means, which: (a) plays one of the musical recordings after a particular event occurs; (b) receives the player's selection of one of the options; and (c) plays any musical variation associated with said selected option.

19. A gaming device having a wager game having a plurality of different functions, the gaming device, comprising:

background music;

a plurality of musical changes to the background music, wherein each musical change is at least a change in a musical variable selected from the group consisting of: key, tempo, style, melody, beat, syncopation, notes, mode, scale, chords, pitch, voice, instrument and a jump from one section of a sound recording to a different section of said sound recording;

a plurality of different wager options for a player, at least two of the wager options associated with: (a) a different one of the musical changes; and (b) a different one of the functions of the gaming device;

computer memory which stores the background music, musical changes and wager options; and a computer in communication with the computer memory which: (a) plays the background music at a particular time; (b) enables the player to select at least one of the wager options; and (c) plays any musical change associated with the selected wager option.

20. A gaming device having a wager game, having a plurality of different functions, the gaming device comprising:

at least one data storage device;

a first sound file and a plurality of second sound files stored in the data storage device, wherein said second sound files are musical variations of said first sound file, each of the second files being different from one another, and wherein the musical variation is at least a change in a musical variable selected from the group consisting of: key, tempo, style, melody, beat, syncopation, notes, mode, scale, chords, pitch, voice, instrument and a jump from one section of a sound recording to a different section of said sound recording;

a plurality of different options stored in the data storage device, at least two of the options associated with: (a) a different one of the second sound files; and (b) a different one of the functions of the wager game;

at least one speaker;

at least one player input device; and a processor in communication with the data storage device, the player input device and the speaker, which: (a) plays the first sound file after a predetermined event occurs; (b) determines which one of the options is selected by the player; (c) plays any second sound file associated with the selected option; and (d) operates the wager game according to the function associated with the selected option.

21. A gaming device comprising:

a game operable upon a wager by a player, the game having a plurality of different functions;

at least one data storage device;

at least one primary sound file stored in the data storage device;

a plurality of variant sound files stored in the data storage device, each variant sound file being a variant of the primary sound file, each of the variant sound files being different than one another, wherein the variation between the primary sound file and each of the variant sound files is at least a change in a music variable selected from the group consisting of: key, style, melody, syncopation, notes, mode, scale, chords, pitch, voice, instrument and a jump from one section of a sound recording to a different section of said sound recording;

a plurality of different options stored in the data storage device, at least two of the options associated with: (a) a different one of the variant sound files; and (b) a different one of the functions;

a plurality of game events stored in the data storage device, each game event associated with one of the different variant sound files, said game events including at least one of: an attract mode, an idle mode, a normal mode, a game play mode, a bonus mode, a cashout mode, a credit roll-up mode, a jackpot mode, a hand pay mode and a player tracking mode;

at least one speaker;

at least one player input device; and a processor operable with the data storage device, the player input device and the speaker to: (a) play the primary sound file after one of the game events occurs; (b) determine which one of the options is selected by the player; (c) play any variant sound file associated with the selected option; and (d) operate the game according to the function associated with the selected option.

22. A gaming device comprising:

a wager game having a plurality of different functions;

a data storage device;

at least one sound file stored in the data storage device;

a plurality of different variations of the sound file stored in the data storage device;

a plurality of different options for the wager game including a set of designated options, each of the designated options associated with: (a) a different one of the variations of the sound file; and (b) a different one of the functions of the wager game;

at least one speaker;

at least one input device enabling the player to select the designated options; and a processor operable with the data storage device, the input device and the speaker to:

(a) play the sound file after a designated event occurs;

(b) determine when the player selects one of the designated options;

(c) play the variation associated with said selected option; and (d) operate the wager game according to the function associated with said selected option.

23. The gaming device of claim 22, wherein at least one of the designated options includes an option selected from the group consisting of whether to place a bet, whether to initiate a play, whether to cash out, whether to increase a bet, whether to change a wager, whether to play a hand and whether to spin one or more reels.

24. A method for operating a gaming device comprising:

providing a game operable upon a wager, the game having a plurality of different functions;

playing a sound file after a designated event occurs;

providing access to a plurality of different variations of the sound file;

associating a plurality of options with: (a) different ones of the variations of the sound file; and (b) different ones of the functions of the game;

enabling a player to select at least one of the plurality of options;

determining which one of the options is selected by the player;

playing the variation associated with the selected option; and operating the game according to the function associated with the selected option.

25. The method of claim 24, wherein enabling the player to select at least one of the plurality of options includes providing the player with the opportunity to perform at least one of the steps selected from the group consisting of placing a bet, initiating a play, cashing out, increasing a bet, changing a wager, playing a hand and spinning one or more reels.

* * * * *

UNITED STATES PATENT AND TRADEMARK OFFICE

CERTIFICATE OF CORRECTION

PATENT NO. : 6,848,996 B2 
DATED : February 1, 2005
INVENTOR(S) : Hecht et al.

It is certified that error appears in the above-identified patent and that said Letters Patent is hereby corrected as shown below:

Column 10,
Line 19, change "file" to -- files --.

Signed and Sealed this

Tenth Day of May, 2005

JON W. DUDAS
*Director of the United States Patent and Trademark Office*